United States Patent [19]

Haber

[11] 4,429,703

[45] Feb. 7, 1984

[54] CIGARETTE SUBSTITUTE

[76] Inventor: William Haber, 5812 Donna Ave., Tarzana, Calif. 91356

[21] Appl. No.: 350,721

[22] Filed: Feb. 22, 1982

[51] Int. Cl.[3] ..... A24F 47/00

[52] U.S. Cl. ..... 131/273

[58] Field of Search ..... 131/273, 339

[56] References Cited

U.S. PATENT DOCUMENTS

| | | | |
|---|---|---|---|
| 2,342,853 | 2/1944 | Furstenberg | 131/273 |
| 3,320,953 | 5/1967 | Rindner | 131/273 |
| 3,521,643 | 7/1970 | Toth | 131/273 |
| 3,946,748 | 3/1976 | Frankfurt | 131/339 |
| 4,083,372 | 4/1978 | Boden | 131/273 |

*Primary Examiner*—V. Millin

*Attorney, Agent, or Firm*—Poms, Smith, Lande & Rose

[57] ABSTRACT

A cigarette substitute assembly has the appearance of cigarette in a cigarette holder. The assembly includes a plain hollow cylindrical tube, with a mouthpiece at one end, and a plastic member at the other end which resembles the ashes on a cigarette. The assembly also includes a cartridge which may be formed of porous material in a cylindrical shape and impregnated with an aromatic substance which may include menthol, to give a pleasant smell and taste simulating inhaling a mild methol type cigarette, when the cartridge is mounted in the assembly and air is drawn through it. A silver-colored washer may be located between the mouthpiece and the end of the white plastic tube. The two end members have inwardly extending fingers which taper slightly to make a tight fit when they are assembled with the central tube, and to grip and enclose the aromatic cartridge. The fingers may be provided with retaining protrusions to more securely hold the filter element in place, and each of these end members are provided with longitudinal passageways so that air may be drawn through the entire assembly. One end of the aromatic cartridge is therefore securely held by one of the end members; and is desired, a resilient metal or plastic element, such as a coil spring of varying diameter, may be provided to hold the other end of the aromatic cartridge centrally within the central plastic tube.

7 Claims, 6 Drawing Figures

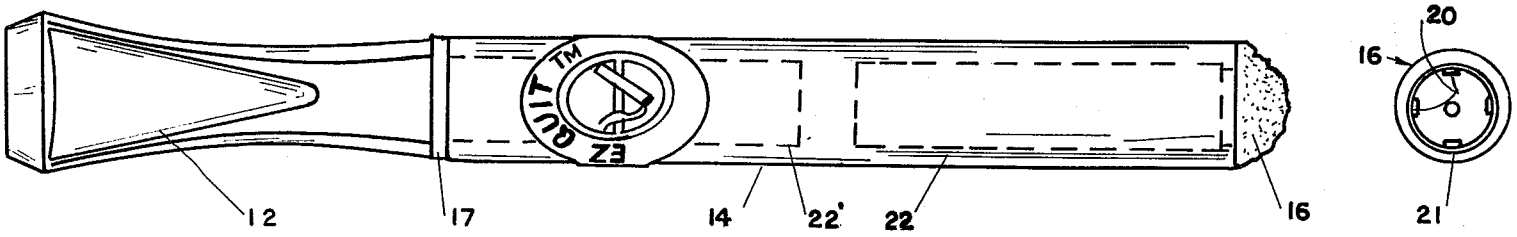
FIG. 1
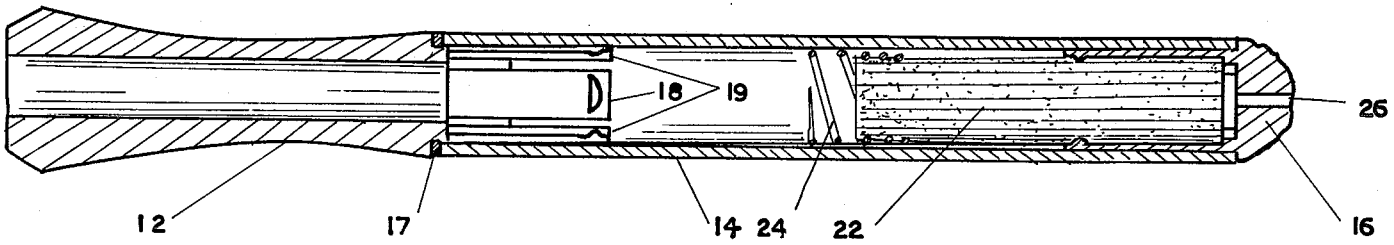
FIG. 2
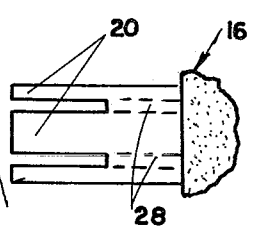
FIG. 3
FIG. 4
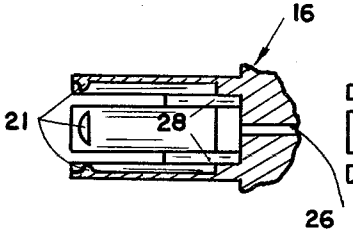
FIG. 5
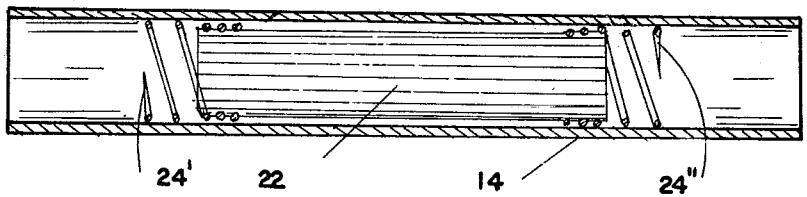
FIG. 6

CIGARETTE SUBSTITUTE

FIELD OF THE INVENTION

The present invention relates to cigarette substitutes for assisting smokers in "kicking the habit".

BACKGROUND OF THE INVENTION

Various cigarette substitute assemblies have been proposed heretofore, and some of these prior art arrangements are shown in S. Furstenberg U.S. Pat. No. 2,342,853, Toth U.S. Pat. No. 3,521,643, and in S. Rindner, U.S. Pat. No. 3,320,953.

However, these prior art arrangements are unnecessarily complex and expensive to manufacture, they do not have desirable air flow qualities in certain cases, and do not have an attractive appearance.

Accordingly, principal objects of the present invention are to overcome the foregoing deficiencies and the high cost of prior proposed cigarette substitute assemblies.

SUMMARY OF THE INVENTION

In accordance with an illustrative embodiment of the invention, a cigarette substitute includes a cylindrical tube which is preferably white in color and elongated to resemble a cigarette, a mouthpiece at one end, and a plastic member at the other end having the appearance of the ashes of a cigarette. A porous aromatic cartridge which is preferably of cylindrical configuration may be mounted within the assembly. The two end members may have slightly tapered elongated fingers to grip the aromatic cartridge and also to firmly and tightly hold the two end members in place within the cylindrical tube. Air passages direct air which is drawn through the assembly, and around the aromatic cartridge to provide a pleasing taste and smell to the user.

In accordance with additional features of the invention, the assembly may be provided with a silver colored washer between the mouthpiece and the cylindrical body portion of the assembly, a plastic or metal spring may be provided to orient and locate the inner end of the aromatic cartridge, and the inwardly extended fingers may be provided with protrusions for engaging and holding the cartridge firmly in place. In addition, at a point recessed within the end members at the base of the fingers, longitudinally extending inner grooves may be provided to permit air to flow past the surface of the cartridge. With this construction, air is channeled through the opening or openings in the outer end member, in intimate contact with the outer surface of the aromatic cartridge, and then through the mouthpiece to the user. In this way, the person who is trying to drop the smoking habit has an occupation for the hands and something to place in the mouth, and the inhalation of the aromatic vapors from the cartridge induces an illusion that the user is actually smoking a mild methol-type cigarette. The continued use of this simulated cigarette enables the smoker over an extended period of time to gradually kick the smoking habit, and is constantly available to help prevent readdiction when the user faces new stress situations.

One feature of the invention involves the use of plain white tubular plastic stock material with smooth inner and outer walls for the main body portion of the assembly. No threads, protruberances, or other discontinuities along the length of the tubular members are needed. In this way, only the two end members must be specially configured, and this substantially reduces the overall costs of the unit.

Other objects, features, and advantages of the invention will become apparent from a consideration of the following detailed description and from the accompanying drawings.

BRIEF DESCRIPTION OF THE DRAWINGS

FIG. 1 is an external view of a cigarette substitute assembly illustrating the principles of the present invention;

FIG. 2 is a longitudinal cross-sectional view taken through the center of the assembly of FIG. 1;

FIG. 3 is a side view of the end member which simulates the ashes at the outer end of the assembly;

FIG. 4 is an end view of the end member shown in FIG. 3, taken from the open end of the member;

FIG. 5 is a cross-sectional view of the element shown in FIGS. 3 and 4; and FIG. 6 is a schematic view of an alternative arrangement.

DETAILED DESCRIPTION

Referring more particularly to the drawings, FIG. 1 is an exterior view and FIG. 2 is a cross-sectional view of a cigarette substitute illustrating the principles of the present invention. In FIGS. 1 and 2 the mouthpiece 12 makes a tight press fit into the hollow white plastic tube 14 which may have the appearance of a cigarette. At the other end of the tube 14 is a second plastic end member 16 which also makes a tight press fit into the tube 14, at its other end. The element 16 is gray in color, simulating cigarette ashes. An accurate fitted silver colored washer 17, which may be made of aluminum, is mounted between the mouthpiece 12 and the white tube 14.

FIGS. 4, 5 and 6 are views which show the details of end member 16 in a side view, and end view and a cross-sectional view, respectively.

Both of the elements 12 and 16 have inwardly tapered flexible fingers 18 and 20, respectively, which not only engage the tube 14, but may also be employed to hold one or more aromatic filter-like cartridge elements 22 in place within the unit. The fingers 18 and 20 may be provided with small protruberances 19 and 21, respectively, which are slanted to permit easy entrance of the cartridge elements, but have vertical sides toward the partially closed ends of the end elements 12 and 16 to hold the cartridges in place.

In FIG. 2 the cartridge 22 has its right hand end held by the element 16, and this is adequate to hold it in place. However, if desired, the inner end may be held more positively centered by an additional spring 24, which may be formed of plastic or metal. If desired, and as indicated in dashed lines in FIG. 1, two aromatic cartridges 22 and 22' may be employed, one held by the fingers 18 on the mouthpiece 12, and the other by the fingers 20 on the plastic element 16. It may be noted that the slots between fingers 20 stop before the end of the aromatic cartridge element 22, which may extend to a point immediately adjacent opening 26, so that the air drawn in through opening 26 must pass adjacent the cartridge 22. At the base of the fingers 18 and 20 grooves 28 extend as partial continuations of the spaces between fingers, to permit circulation of air past the cartridge element 22.

FIG. 6 indicates an alternative arrangement in which the filter element 22″ is held in place within tube 14 by two springs 24′ and 24″.

For completeness, it may be noted that the tube 14 is preferably white in color, and may be made of polypropylene. The mouthpiece 12 may be made of any desired type of high strength plastic meeting FDA standards. It may be black in color, or may be transparent amber colored with a swirl of black embedded in the plastic. The washer 17 is preferably silver colored, and may be formed of aluminum, or may be a plated washer. The plastic end member 16 is preferably gray in color and may be made of any suitable, easily molded non-toxic plastic material. The springs 24 may be made of stainless steel, of other metals, or of plastic. The aromatic cartridges are formed of fibrous, porous material, similar to cigarette filters, and are impregnated with menthol or other desired aromatic materials, which provide a pleasing taste and smell when air is drawn through them. Unlike cigarette holders, the assembly of the present invention is not subject to the high temperatures of a burning cigarette, and accordingly, the required temperature resistant mechanical properties may be somewhat less stringent.

In conclusion, it is to be understood that the foregoing description and accompanying drawings merely relate to one illustrative embodiment of the invention. Various changes and alternative constructional features may be employed. Thus by way of example and not of limitation, instead of a single hole at the outer end of the end member which has the appearance of the ashes, a plurality of small holes may be provided; the silver-colored washer may be dispensed with, if desired; a single long aromatic cartridge element could be employed, extending the entire distance between the two end members; and the aromatic cartridge may have various vapors to simulate both menthol and other types of cigarettes. Accordingly, it is to be understood that the present invention is not limited to that precisely as shown and described hereinabove.

What is claimed is:

1. A cigarette substitute assembly comprising:
a hollow elongated cylindrical tube;
a mouthpiece making a tight fit into one end of said tube to form one end member of said assembly;
a second end member of said assembly, resembling the ashes of a cigarette making a tight fit into the other end of said tube, said second member being hollow and having at least one opening at the outer end thereof;
aromatic cartridge means for producing a pleasing taste and smell when air is drawn over it, mounted within said assembly;
at least one of said end members including fingers and gripping means extending into said tube and firmly engaging said cartridge means to direct air over the surface of said cartridge when suction is applied to the user to the mouthpiece to draw air through the opening in the second end member; and
additional means mounted within said tube for supporting the inner end of said cartridge, said supporting means being a metal spring of coil configuration having coils or turns of various diameters;
whereby the inhalation of the aromatic vapors induces the illusion of smoking a mild cigarette, thus aiding the user in stopping smoking.

2. A cigarette substitute assembly comprising:
a hollow elongated cylindrical tube;
a mouthpiece making a tight fit into one end of said tube to form one end member of said assembly;
a second end member of said assembly, resembling the ashes of a cigarette making a tight fit into the other end of said tube, said second member being hollow and having at least one opening at the outer end thereof;
aromatic cartridge means for producing a pleasing taste and smell when air is drawn over it, mounted within said assembly;
both of said end members including finger means extending into said tube to firmly engage said tube and to secure said end members to said tube; and
spring means for holding at least one end of said cartridge within said tube;
whereby the user may taste and smell the harmless aromatic flavor from the cartridge while holding the cigarette substitute in the mouth and drawing air through the assembly thus aiding the user in stopping smoking.

3. A cigarette substitute assembly comprising:
a hollow elongated cylindrical tube, said tube being a smooth plain hollow tube with inner and outer continuous cylindrical surfaces from end to end;
a mouthpiece making a tight fit into one end of said tube to form one end member of said assembly;
a second end member of said assembly, resembling the ashes of a cigarette making a tight fit into the other end of said tube, said second end member being hollow and having at least one opening at the outer end thereof;
aromatic cartridge means for producing a pleasing taste and smell when air is drawn over it, mounted within said assembly;
both of said end members including individual spaced finger means extending longitudinally away from the end members and into said tube to firmly engage said tube and to secure said end members to said tube; and
means for engaging and holding said aromatic cartridge means within said tube and spaced from the side walls thereof, and with the ends of said cartridge open and spaced from said fingers;
whereby the user may taste and smell the harmless aromatic flavor from the cartridge while holding the cigarette substitute in the mouth and drawing air through the assembly thus aiding the user in stopping smoking.

4. A cigarette substitute assembly as defined in claim 1 further including spring means for holding at least one end of said cartridge within said tube.

5. A cigarette substitute assembly as defined in claim 1 further including a silver colored washer mounted between said mouthpiece and said tube.

6. A cigarette substitute assembly as defined in claim 1 wherein said fingers are slightly tapered inwardly to increase the securing force tending to hold said end members into said tube.

7. A cigarette substitute assembly as defined in claim 1 wherein at least one of said end members is provided with grooves for directing air in close proximity to the surface of said cartridge.

* * * * *